US011452906B2

(12) United States Patent
Leier et al.

(10) Patent No.: US 11,452,906 B2
(45) Date of Patent: Sep. 27, 2022

(54) EXERCISE APPARATUS

(71) Applicant: Expectations, LLC, Bonney Lake, WA (US)

(72) Inventors: Christopher H. Leier, Lake Tapps, WA (US); Nicholas M. Soller, Edgewood, WA (US)

(73) Assignee: Expectations, LLC, Bonney Lake, WA (US)

( * ) Notice: Subject to any disclaimer, the term of this patent is extended or adjusted under 35 U.S.C. 154(b) by 74 days.

(21) Appl. No.: 17/215,556

(22) Filed: Mar. 29, 2021

(65) Prior Publication Data

US 2021/0308519 A1 Oct. 7, 2021

Related U.S. Application Data

(60) Provisional application No. 63/003,481, filed on Apr. 1, 2020.

(51) Int. Cl.
*A63B 22/00* (2006.01)
*A63B 22/06* (2006.01)

(52) U.S. Cl.
CPC ..... *A63B 22/0076* (2013.01); *A63B 22/0664* (2013.01); *A63B 2022/0084* (2013.01); *A63B 2022/0676* (2013.01); *A63B 2210/58* (2013.01)

(58) Field of Classification Search
CPC ..... A63B 22/0087–0089; A63B 22/0664–2022/0688; A63B 22/208; A63B 69/04; A63B 69/06–2069/066; A63B 22/0015–0017; A63B 22/0046; A63B 23/035; A63B 23/03575
See application file for complete search history.

(56) References Cited

U.S. PATENT DOCUMENTS

| | | | | |
|---|---|---|---|---|
| 5,836,855 | A * | 11/1998 | Eschenbach | A63B 22/0015 482/57 |
| 7,141,008 | B2 | 11/2006 | Krull et al. | |
| 10,518,126 | B1 | 12/2019 | Krull | |
| 2008/0200265 | A1* | 8/2008 | Chuang | A63B 69/04 472/29 |
| 2008/0200267 | A1* | 8/2008 | Chuang | A63B 69/0068 472/29 |
| 2008/0200271 | A1* | 8/2008 | Chuang | A63B 69/0068 472/96 |

* cited by examiner

*Primary Examiner* — Jennifer Robertson
(74) *Attorney, Agent, or Firm* — Dicke, Billig & Czaja, PLLC

(57) ABSTRACT

An exercise apparatus includes a user supporting member having a beam member at one end and a U-shaped member at an opposite end. At least one bracket is rigidly interconnected between the beam member and the U-shaped member. One such bracket is welded onto a middle portion of the U-shaped member to underlie and directly support a proximate end of the beam member. At least one bolt extends through the beam and the bracket to establish a rigid connection therebetween. In a preferred application, a seat is mounted on the user supporting member, and the user supporting member is part of a linkage assembly operatively connected to a frame to move the seat through at least one elliptical path.

14 Claims, 4 Drawing Sheets

EXERCISE APPARATUS

FIELD OF THE INVENTION

The present invention relates to exercise apparatus and improved ways to make and package such apparatus, and more specifically, to exercise equipment that supports a user on a seat for movement through an elliptical path.

BACKGROUND OF THE INVENTION

U.S. Pat. No. 7,141,008 to Krull et al. discloses certain embodiments of an exercise apparatus that may be described as an elliptical rowing exercise machine. Generally speaking, such a machine includes a relatively long structural member that supports a user in a seated position for movement through at least one elliptical path. One end of the member is preferably forked for connection to left and right sides of a rotating crank, while the other end of the member is preferably a beam that supports a seat. During use of such apparatus, considerable stress and strain may be present in the middle of this structural member, where the beam is joined to the forked member. Also, the size and weight of such apparatus make it undesirable to ship in a single box. An object of the present invention is to provide new and improved methods and apparatus for ensuring a reliable and practical joint and/or separation point on the user supporting member on elliptical rowing exercise apparatus, and more generally, on various types of user supports on other types of exercise apparatus.

SUMMARY OF THE INVENTION

In one respect, the present invention may be described in terms of an exercise apparatus, comprising: a frame; a crank rotatably mounted on the frame for rotation about an axis, wherein the crank defines left and right crank connection points at a common radial distance from the axis; and a user support link movably interconnected between the crank and the frame. The link includes (a) a generally U-shaped member having left and right end segments operatively connected to respective said left and right crank connection points, and a middle portion integrally interconnected between the left and right end segments; (b) a beam having a first end movably linked to the frame and an opposite, second end overlying the middle portion of the U-shaped member; and (c) at least one bracket rigidly interconnected between the second end of the beam and the middle portion of the U-shaped member.

In another respect, the present invention may be described in terms of an improved elliptical rowing exercise apparatus of the type having (a) a frame; (b) a crank rotatably mounted on one end of the frame; (c) a rocker link pivotally mounted on an opposite end of the frame; (d) a rigid, user supporting member having a forked portion that is rotatably connected to respective left and right sides of the crank and an opposite, beam portion that is pivotally connected to the rocker link; and (e) a seat mounted on the beam portion of the user supporting member. In this context, the improvement may be described as comprising a bracket rigidly mounted on top of a middle segment of the forked portion to define an upwardly facing surface, wherein a proximate end of the beam portion rests on top of the upwardly facing surface on the bracket and is rigidly secured thereto by at least one bolt.

In yet another respect, the present invention may be described in terms of a method of assembling an exercise apparatus. One step of the method involves providing a frame, a crank rotatably mounted on one end of the frame, a forked member having left and right ends rotatably connected to respective left and right sides of the crank, a rocker link pivotally mounted on an opposite end of the frame, a beam having a first end pivotally connected to the rocker link and an opposite, second end, and a bracket rigidly mounted on top of a middle portion of the forked member to define an upwardly facing surface. The second end of the beam is positioned on top of the upwardly facing surface on the bracket, and then the second end of the beam is rigidly secured to the bracket.

Various features of and/or applications for the present invention may become more readily apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
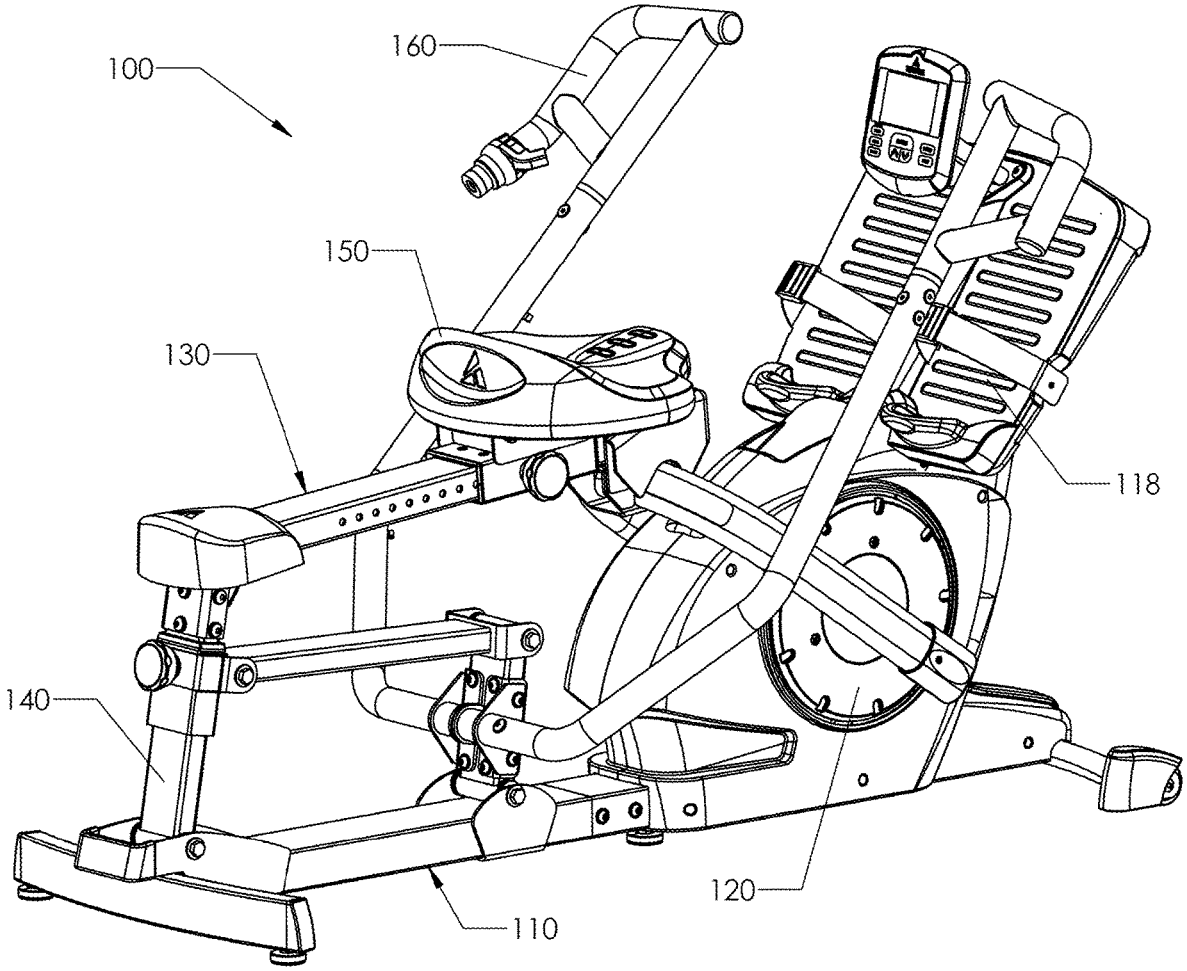
FIG. 1 is a perspective view of an exercise apparatus constructed according to the principles of the present invention.

A preferred embodiment exercise apparatus constructed according to the principles of the present invention is designated as 100 in FIG. 1. Generally speaking, the exercise apparatus 100 is functionally similar to the exercise apparatus disclosed in U.S. Pat. No. 7,141,008 to Krull et al., which is incorporated herein by reference. More specifically, the only distinction that is the subject of the present invention involves the structural member or seat supporting member designated as 130 in the drawings. As a result, this disclosure will focus primarily on the structural member 130 with the understanding that persons skilled in the art will glean other aspects and features of the subject invention from the above-identified patent together with the description that follows.

The exercise apparatus 100 includes a frame 110 that is comprised of interconnected steel tubes and configured to occupy a stable operative position on an underlying floor surface. A foot platform 118 is rigidly mounted on a forward end of the frame 110.

Figure 3:
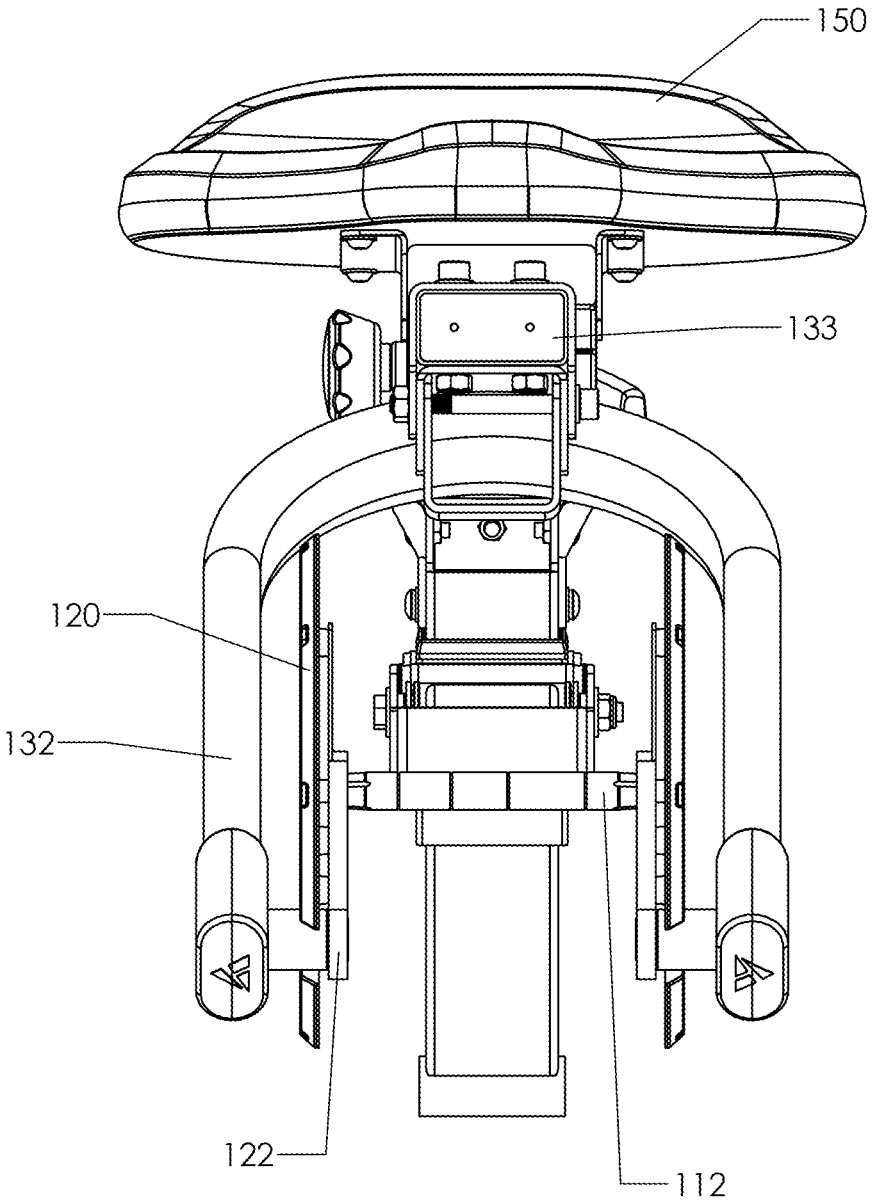
FIG. 3 is a front view of a linkage assembly on the exercise apparatus of FIG. 1.

FIG. 3 shows components of a linkage assembly apart from other components, including the frame 110. The linkage assembly includes a shaft 112 having a middle portion that is rotatably mounted on the frame 110, via conventional bearings or other known means, for rotation about an axis. The linkage assembly is symmetrical about a plane of symmetry extending through a midpoint of the shaft 112.

Left and right crank arms 122 are rigidly secured to respective left and right ends of the shaft 112. The left and right crank arms 122 are mirror images of one another and extend a common radial distance in a common direction away from the shaft 112. Left and right crank covers 120 are rigidly mounted on respective left and right crank arms 122 to shroud the crank portion of the linkage assembly.

The structural member 130 includes a generally U-shaped or forked member 132. On the preferred embodiment 100, the member 132 comprises a steel tube having an oval cross-section and bent into a U-shape. As such, the generally U-shaped member 132 includes left and right ends or end segments and a curved middle portion or middle segment extending therebetween. Each end of the U-shaped member 132 is rotatably connected to an outer end of a respective left or right crank arm 122.

The structural member 130 also includes a beam 134. On the preferred embodiment 100, the beam 134 comprises a steel tube having a rectangular cross-section and extending linearly. As such, the beam 134 has a first end and an opposite, second end. The second end overlies the middle portion of the member 132, and is rigidly secured thereto by means of at least one bracket, as further described below. A metal plug and/or cap 133 is preferably welded inside and/or across the otherwise open second end of the beam 134 to enhance structural integrity. The first end of the beam 140 is rotatably connected to an upper end of a rocker link 140, and an opposite, lower end of the rocker link 140 is rotatably connected to the frame 110.

As described above, the resulting linkage assembly causes intermediate points along the beam 134, between the first end and the second end, to move through respective elliptical paths as the crank arms 122 (and the shaft 112) rotate through complete revolutions. The elliptical paths closer to the first end of the beam 134 (proximate the rocker link 140) have relatively smaller (vertical) minor axes, and the elliptical paths closer to the second end of the beam 134 (proximate the crank shaft 112) have relatively larger (vertical) minor axes. A seat 150 is mounted on the beam 134 and selectively movable along the beam 134 to move through any of several of these elliptical paths, depending on the location of the seat 150 along the beam 134.

Figure 2:
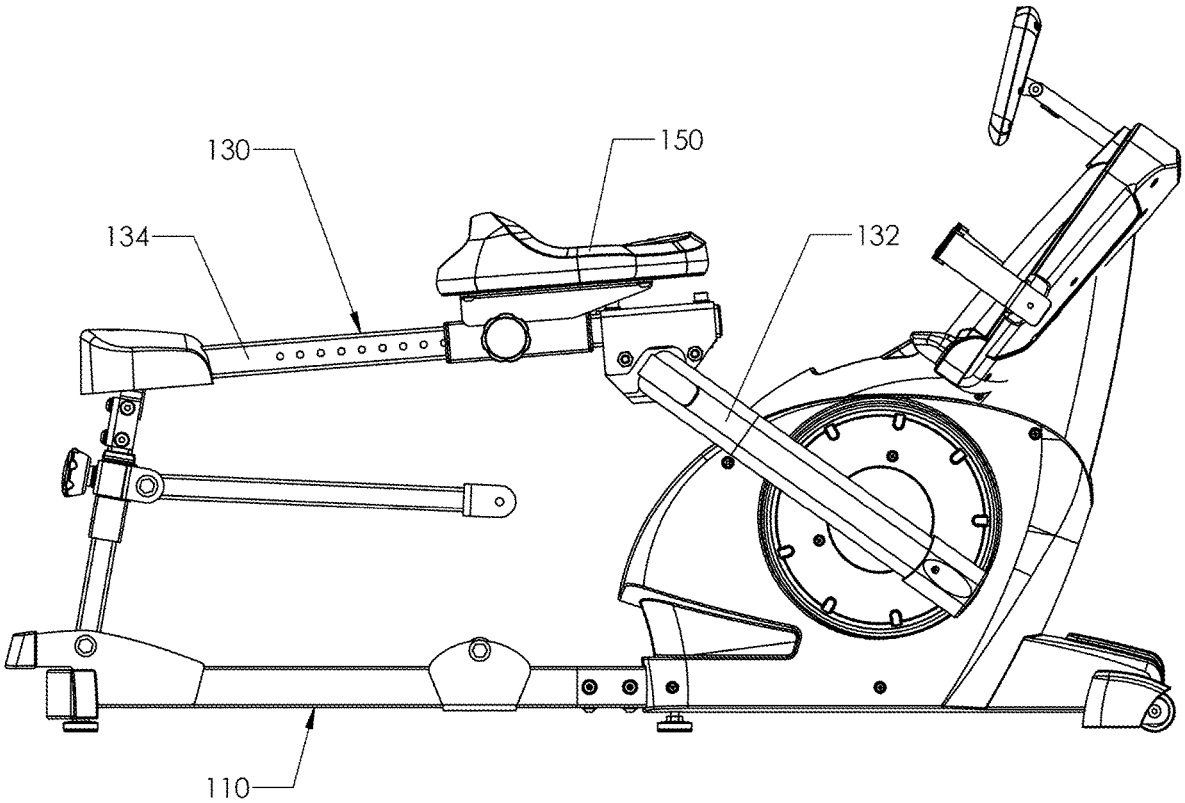
FIG. 2 is a side view of the exercise apparatus of FIG. 1, with a handlebar component removed to reveal other parts.

As shown in FIG. 1, a handlebar assembly 160, including left and right handles, is rotatably mounted on the frame 110 and linked to the rear rocker link 140. As a result, the left and right handles move through arcuate paths as the seat 150 moves through an elliptical path. The handlebar assembly 160 is omitted from FIGS. 2 and 3 for ease of illustration and more detailed focus on the subject matter of the present invention.

Figure 4:
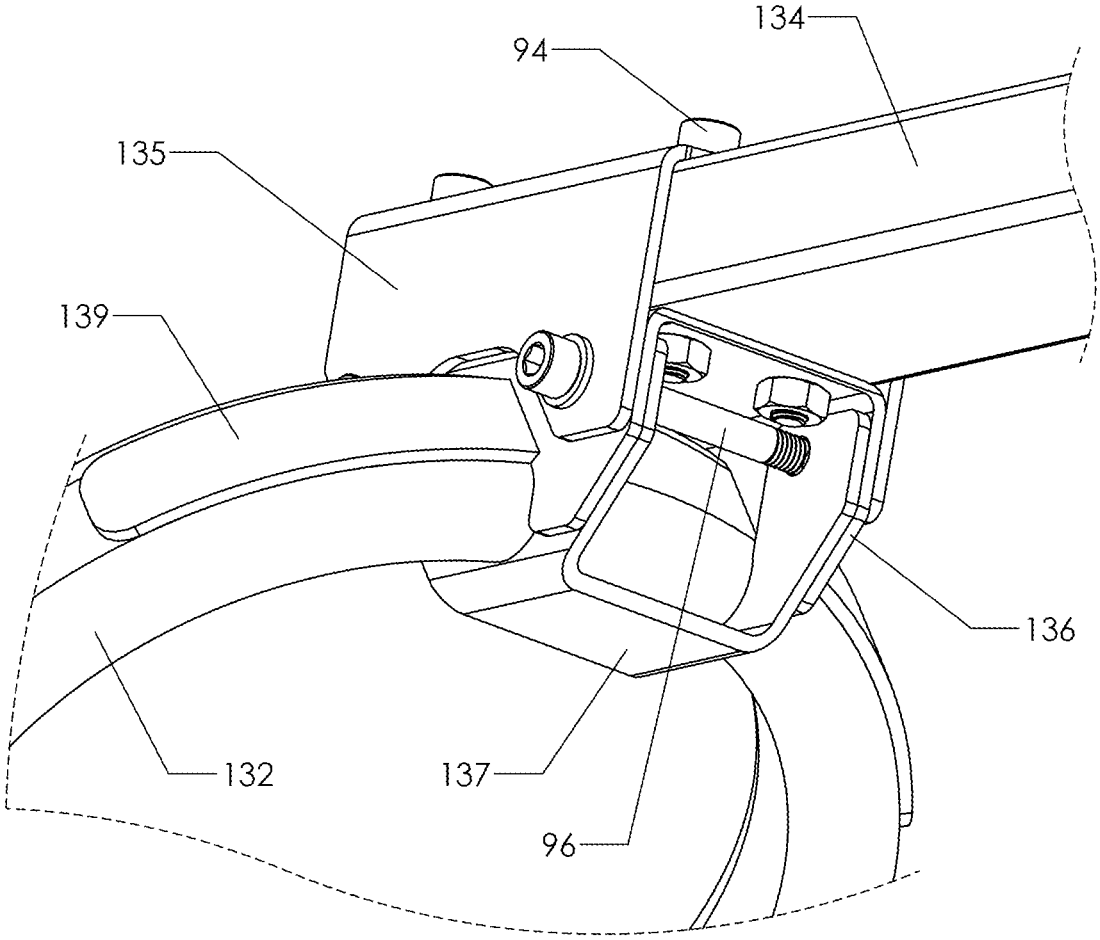
FIG. 4 is a fragmented perspective view of a structural joint on the exercise apparatus of FIG. 1.

FIG. 4 focuses on the joint or juncture between the beam 134 and the U-shaped member 132. As noted above, at least one bracket is interconnected between the middle segment of the U-shaped member 132 and the second end of the beam 134. On the preferred embodiment 100, three brackets 135-137 are interconnected between the U-shaped member 132 and the beam 134. All three brackets are preferably made of steel plates that have been bent into U-shaped configurations that include left and right flanges and a flat, middle plate portion. The three brackets 135-137 may alternatively be described as a bracket assembly and/or a multi-part bracket.

The bracket 136 may be described as the middle bracket, as its flanges are sandwiched between the flanges of the other two brackets 135 and 137. The flanges of the middle bracket 136 define downwardly opening notches sized and configured to match and receive respective upwardly facing segments of the middle portion of the U-shaped member 132. The flanges of the middle bracket 136 are rigidly secured to the U-shaped member 132, preferably by welding. In addition, steel strips 139 are preferably welded onto adjacent portions of the flanges and the U-shaped member 132 to provide additional reinforcement and further enhance structural integrity. The middle plate portion of the middle bracket 136 is disposed a distance above the U-shaped member 132, and defines an upwardly facing flat surface to match and receive a downwardly facing flat surface on the second end of the beam 134.

The bracket 137 may be described as the lower bracket, as its middle plate portion is disposed beneath the plate portions of the other brackets 135 and 136. The flanges of the lower bracket 137 define upwardly opening notches sized and configured to match and receive respective downwardly facing segments of the middle portion of the U-shaped member 132. The flanges of the lower bracket 137 are rigidly secured to the U-shaped member 132, preferably by welding. The middle plate portion of the lower bracket 137 is disposed a distance below the U-shaped member 132. The flanges of the lower bracket 137 are spaced just close enough together to fit between the flanges of the middle bracket 136. In one sense, the brackets 136 and 137 may be described as forming a box-like structure around the middle segment of the U-shaped member 132.

The bracket 135 may be described as the upper bracket, as its middle plate portion is disposed above the plate portions of the other brackets 136 and 137. More specifically, the middle plate portion of the upper bracket 135 defines a flat downwardly facing surface to match and rest on top of the second end of the beam 134. The flanges of the upper bracket 135 are spaced just far enough apart to receive the flanges of the middle bracket 136 therebetween.

One way to assemble the structural member 130 is to rigidly secure all the brackets 135-137 to one another and to the U-shaped member 132. In one such method, welding is preferred except that at least one conventional nut and bolt 96 and preferably two conventional nuts and bolts 96 may be used in lieu of welding the upper bracket 135 to the other brackets 136 and 137. In an alternative method, all relevant parts may be welded together, in which case the bolts 96 may be eliminated to reduce cost and/or simplify the manufacturing process. As a final assembly step, the second end of the beam member 134 is inserted into the upper bracket 135 and then rigidly secured in place via at least one conventional nut and bolt 94 and preferably four conventional nuts and bolts 94.

Yet another way to assemble the structural member 130 is to rigidly secure the brackets 136-137 to one another and to the U-shaped member via welding. Similarly, the upper bracket 135 is welded to the second end of the beam 134. As a final assembly step, the second end of the beam member 134 is positioned on top of the middle bracket 136, with the flanges of the middle bracket 136 nested inside the flanges of the upper bracket 135, and then the two sub-assemblies are rigidly secured to one another via a first set of conventional nuts and bolts 94 and a second set of conventional nuts and bolts 96.

The subject invention has been described with reference to a preferred embodiment and a particular application with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of allowable claims that issue from this application or any related application.

What is claimed is:

1. An exercise apparatus, comprising:

a frame configured to rest on a floor surface;

a crank rotatably mounted on the frame for rotation about an axis, wherein the crank defines left and right crank connection points at a common radial distance from the axis;

a generally U-shaped member having left and right end segments operatively connected to respective said left and right crank connection points, and a middle portion integrally interconnected between the left and right end segments;

a beam having a first end movably linked to the frame and an opposite, second end overlying the middle portion of the U-shaped member;

at least one bracket rigidly interconnected between the second end of the beam and the middle portion of the U-shaped member; and a seat mounted on the beam between the first end and the second end.

2. The exercise apparatus of 1, wherein said at least one bracket includes an intermediate bracket rigidly mounted on top of the middle portion of the U-shaped member and defining an upwardly facing flat surface.

3. The exercise apparatus of 2, wherein the second end of the beam defines a downwardly facing flat surface that rests on top of the upwardly facing flat surface.

4. The exercise apparatus of 3, wherein the intermediate bracket is welded to the middle portion of the U-shaped member.

5. The exercise apparatus of 2, wherein at least one bolt extends through the intermediate bracket and the second end of the beam.

6. The exercise apparatus of 2, wherein the U-shaped member defines a cross-sectional profile, and the intermediate bracket is notched to receive an upwardly facing segment of the profile.

7. The exercise apparatus of 2, wherein the intermediate bracket comprises a metal plate that is bent in two places to define a left flange and a right flange and a plate portion therebetween.

8. The exercise apparatus of 7, wherein the U-shaped member defines a cross-sectional profile, and each said flange is notched to receive a respective upwardly facing segment of the profile.

9. The exercise apparatus of 7, wherein a vertical distance is defined between the plate portion and the U-shaped member.

10. An improved elliptical rowing exercise apparatus of the type having (a) a frame; (b) a crank rotatably mounted on one end of the frame; (c) a rocker link pivotally mounted on an opposite end of the frame; (d) a rigid, user supporting member having a forked portion that is rotatably connected to respective left and right sides of the crank and an opposite, beam portion that is pivotally connected to the rocker link; and (e) a seat mounted on the beam portion of the user supporting member, the improvement comprising:

a bracket rigidly mounted on top of a middle segment of the forked portion to define an upwardly facing surface, wherein a proximate end of the beam portion rests on top of the upwardly facing surface on the bracket and is rigidly secured thereto by at least one bolt.

11. An exercise apparatus, comprising:

a frame configured to rest on a floor surface;

a crank rotatably mounted on the frame for rotation about an axis;

a member having a first portion operatively connected to the crank, and a second portion spaced apart from the first portion;

a beam having a first end movably linked to the frame and an opposite, second end overlying the second portion of the member;

at least one bracket rigidly interconnected between the second end of the beam and the second portion of the member; and a seat mounted on the beam between the first end and the second end.

12. The apparatus of 11, wherein said at least one bracket defines an upwardly facing flat surface.

13. The rowing exercise apparatus of 12, wherein the second end of the beam defines a downwardly facing flat surface that rests on top of the upwardly facing flat surface.

14. The rowing exercise apparatus of 12, wherein at least one bolt extends through the at least one bracket and the second end of the beam.

* * * * *